US006608978B2

(12) United States Patent
Robertson et al.

(10) Patent No.: US 6,608,978 B2
(45) Date of Patent: Aug. 19, 2003

(54) PAPER-SAVING METHODS FOR PRINTING A DOCUMENT

(75) Inventors: Alan K. Robertson, Rochester, NY (US); Jean S. Beha, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/020,992

(22) Filed: Dec. 19, 2001

(65) Prior Publication Data

US 2003/0113130 A1 Jun. 19, 2003

(51) Int. Cl.[7] ..... G03G 15/00
(52) U.S. Cl. ..... 399/82; 399/85
(58) Field of Search ..... 399/82, 83, 85, 399/401; 358/450

(56) References Cited

U.S. PATENT DOCUMENTS 4,731,637 A 3/1988 Acquaviva et al. ..... 355/14
4,839,740 A 6/1989 Yoshida ..... 358/288
5,634,187 A * 5/1997 Ross ..... 399/365
2002/0071689 A1 * 6/2002 Miyamoto ..... 399/53

FOREIGN PATENT DOCUMENTS

JP 5-347701 A * 12/1993

* cited by examiner

*Primary Examiner*—Joan Pendegrass
(74) *Attorney, Agent, or Firm*—Joseph M. Young

(57) ABSTRACT

A paper-conserving method for printing a document, which includes determining the number of pages in a document to be printed and automatically selecting a paper conserving print layout for the document when at least two pages are detected. When the document has two or more pages, the layout includes duplexing. When the document has 3 or more pages, the layout will be N-up, where N has a value of at least 2.

19 Claims, 8 Drawing Sheets

PAPER-SAVING METHODS FOR PRINTING A DOCUMENT

BACKGROUND AND SUMMARY

The present invention relates to methods of printing documents and apparatuses thereof, and more specifically to printing documents in a manner that reduces the use of paper per print job.

Popular print drivers such as the Adobe PostScript driver for Windows 95 offer options to select duplex, and N-Up printing. When used appropriately, these options can save tremendous amounts of paper. This same opportunity also applies to digital copiers such as the Xerox DC 230 that can duplex and N-Up paper originals while copying.

However, these features require particular effort on the part of the user to select options appropriate for each document printed or copied. It follows that the potential savings will not be realized if the user is either not aware of the features, is not familiar with the best ways to use them, or does not remember or take the time to use them daily.

Another problem is that print driver settings used for one print job may remain and be accidentally applied to future jobs. This may render some future print jobs unacceptable and result in more wasted paper.

All references cited in this specification, and their references, are hereby incorporated by reference where appropriate for relevant teachings of additional or alternative details, features, and/or technical background.

Embodiments disclosed herein are directed to a simple method for delegating paper saving decisions to the printing device so that each job can be optimized automatically. This feature could be prominently displayed in both the print driver UI and in the digital copier's or printer's local UI to draw attention to it, and to enable the customer to select smart paper saving mode in a single step.

Embodiments include a paper-conserving method for printing a document, which includes determining the number of pages in a document to be printed and automatically selecting a paper conserving print layout for the document when at least two pages are detected; and duplexing when the document has two or more pages. Other embodiments include printing N-up when the document has 3 or more pages, where N has a value of at least 2.

BRIEF DESCRIPTION OF THE DRAWINGS

The invention will be described in detail herein with reference to the following figures in which like reference numerals denote like elements and wherein.

DETAILED DESCRIPTION OF EMBODIMENTS

While the present invention will be described with reference to specific embodiments thereof, it will be understood that the invention is not to be limited to these embodiments. It is intended that the present invention encompass all alternatives, modifications, and equivalents as may be included within the spirit and scope of the invention. Other aspects of the present invention will become apparent.

Documents include paper, plastic, transparencies, and the like. The term paper has been used generally for substrates upon which images can be printed at various places throughout this application. However, the methods and apparatuses disclosed herein are not limited to paper printing.

Figure 1:
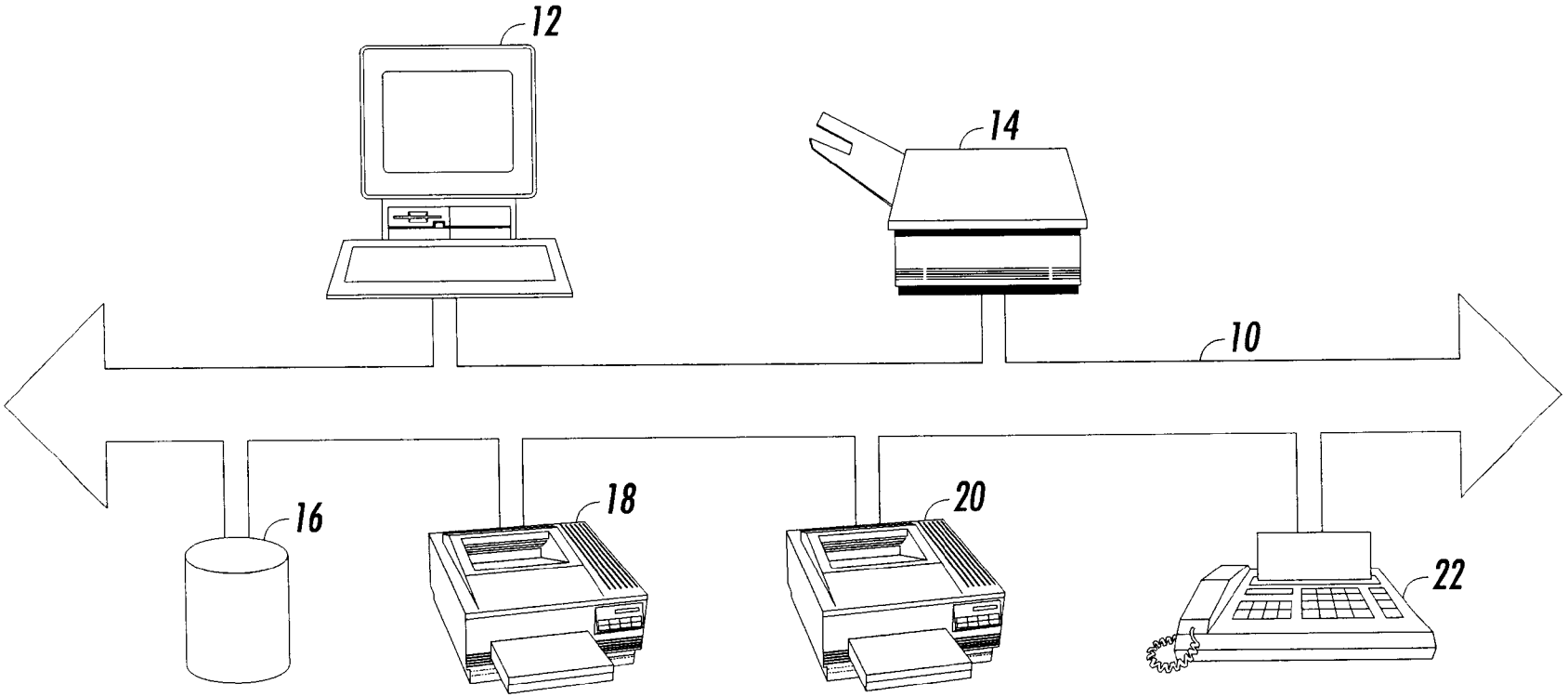
FIG. 1 is simplified diagram showing a networked document services system in which the present invention can be useful.

FIG. 1 is a simplified diagram showing an example of a networked document-services system in which the present invention is useful. A network bus 10, which may be of any type known in the art, such as Ethernet or Token-Ring, interconnects a number of computers and peripherals. For example, on network 10 there would be typically any number of personal computers such as 12, scanners such as 14, shared memories such as 16, and of course printing devices such as 18 and 20. The network 10 may further interconnect a fax machine 22, which in turn connects with a standard telephone network. What is important is that the various computers and peripherals can interact to perform various document services.

Figure 2:
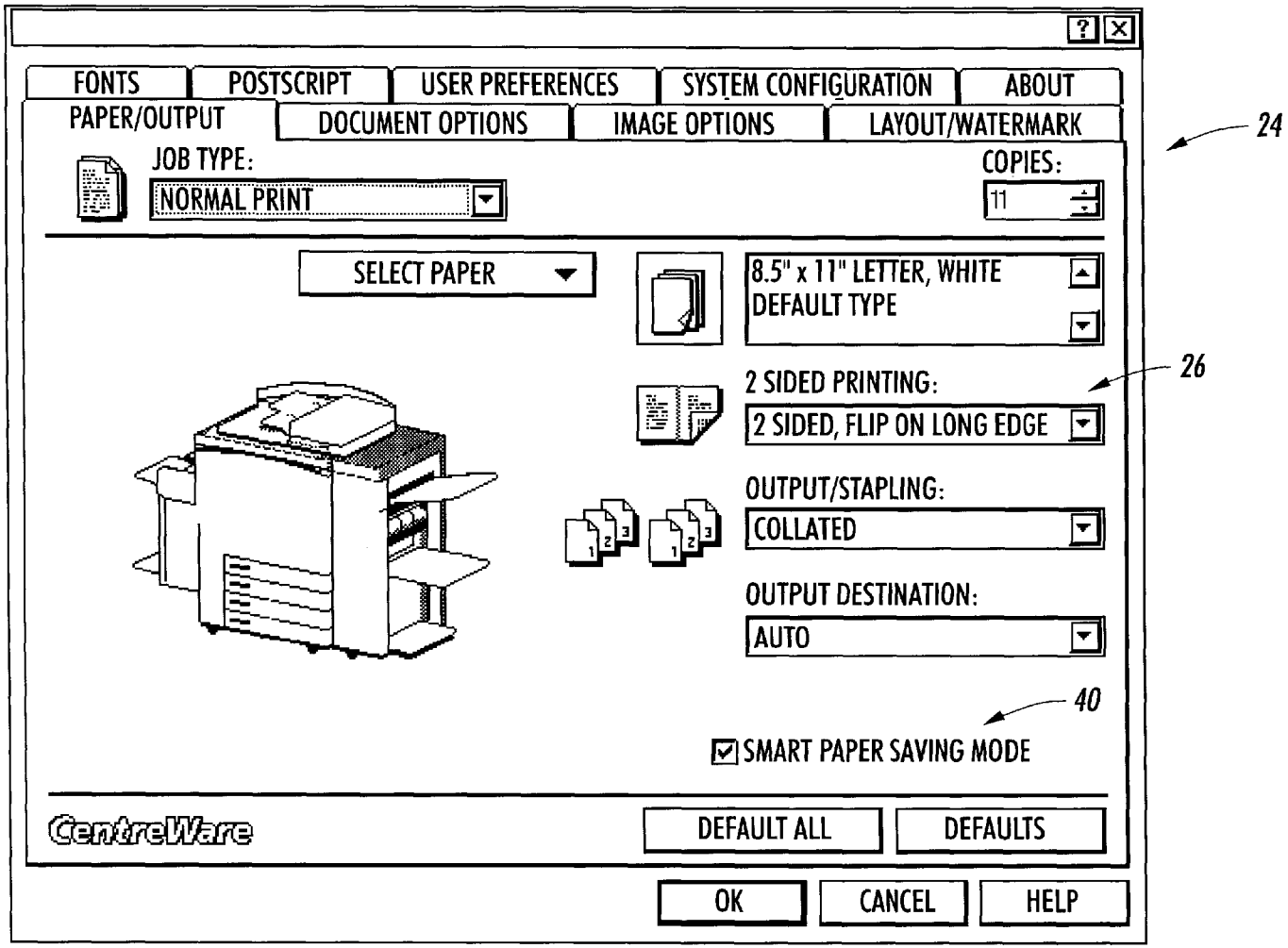
FIG. 2 is an example of a window in a graphical UI of a print driver.

FIG. 2 illustrates a graphical user interface (GUI) which can be displayed on a screen of the computer 12 shown in FIG. 1. The window shown in FIG. 2 is an example of a screen 24 of a GUI associated with a printing device that would be used in a networked document services environment. A printing device can be a printer, a copier, or a device capable of both operations. The GUI can be created by a print driver inside a computer or a controller inside the printing device. In the case of the latter, screen 24 would be displayed directly on the printing device. The GUI of FIG. 2 displays to the user a varied set of features, of which the printing device being controlled is capable.

In embodiments, many features are displayed in the form of pull-down menus, and pulling down any pull-down menu will display to the user a list of options associated with that feature. These menus allow the user to select a variety of output options for a print job. These output options define the layout of the print job. For example, the user will typically be offered the choice of printing one or two sided copies. The embodiment shown in FIG. 2 displays a pull-down menu 26 under the heading "2 sided printing," under which the user has the option of selecting one of the following options: I sided (typically the default choice), 2 sided, flip on the long side, or 2 sided flip on the short side.

If a user selects no specific features for the layout, the print driver will use predetermined default parameters when printing a job. The user may preset these printing parameters in the printer's controller or in the print driver of a connected computer before it is used, or the user may buy the device with pre-programmed "factory" presets.

Figure 3:
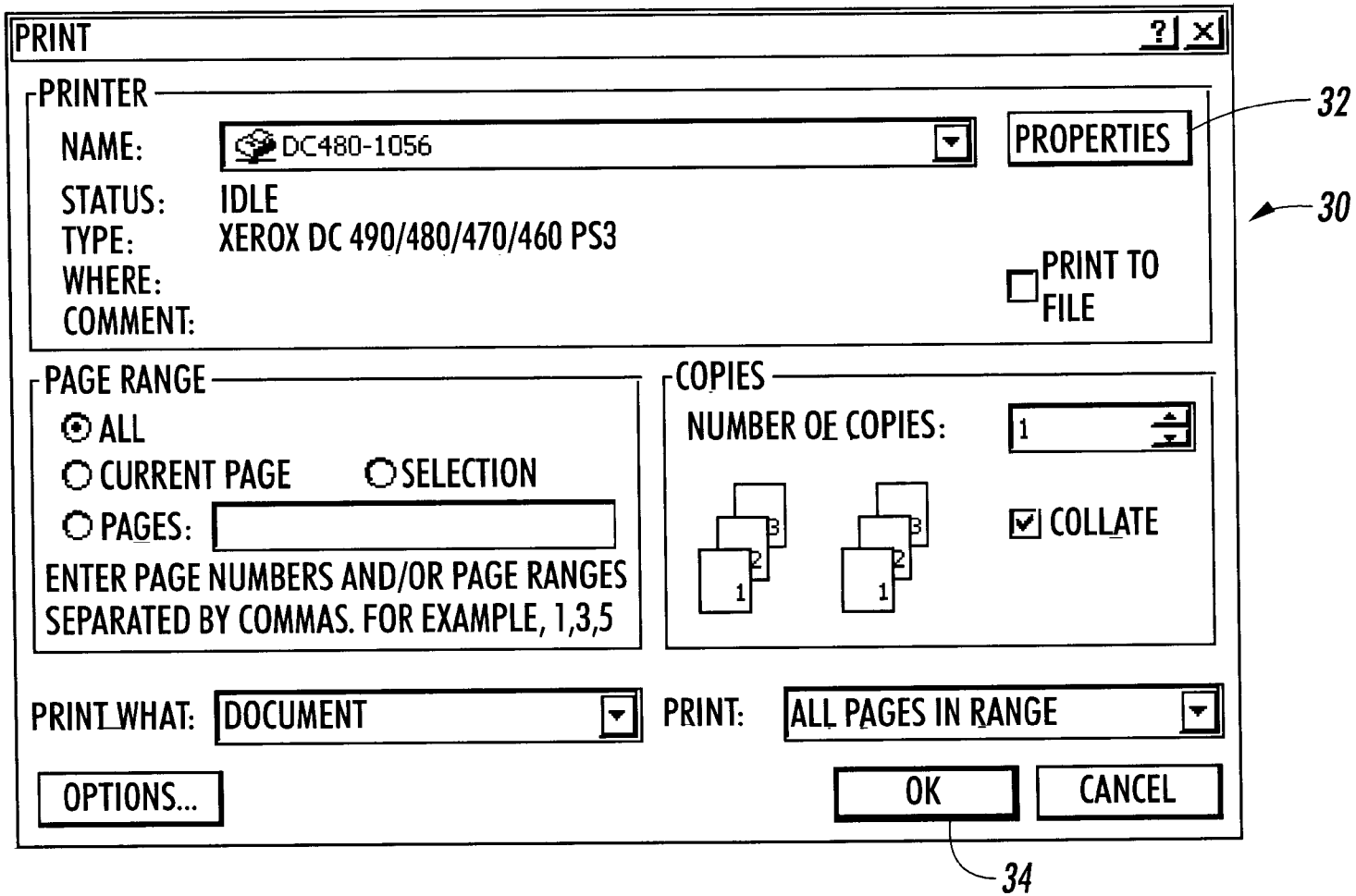
FIG. 3 is an example of an application interface.

If the user wishes to alter the default printing parameters, he or she can access the GUI of the controller directly on the printing device, or the GUI of the print driver either directly on a computer or through an application interface. Often, the user will print a document to a printing device from their desktop computer. FIG. 3 is an example of an interface screen 30 for an application running on a desktop computer. Typically, a window identifying the printing device to which a print job is being sent will be present. A button or tab next to or near this window will access the print driver of the device to which the job is being sent. For example, in FIG. 3, next to the window is a button 32 labeled "properties." If the user clicks on this tab, the print driver's GUI screen 24 will appear.

When the buyer or user accesses either the controller or the print driver interface, he or she will see a checkbox 40 that will allow him or her to turn on a paper-conserving feature that balances reducing paper usage with appearance of output. In FIG. 2, this box 40 is labeled "Smart Paper Saving Mode." This wording is meant to be exemplary and not limiting.

Figure 4:
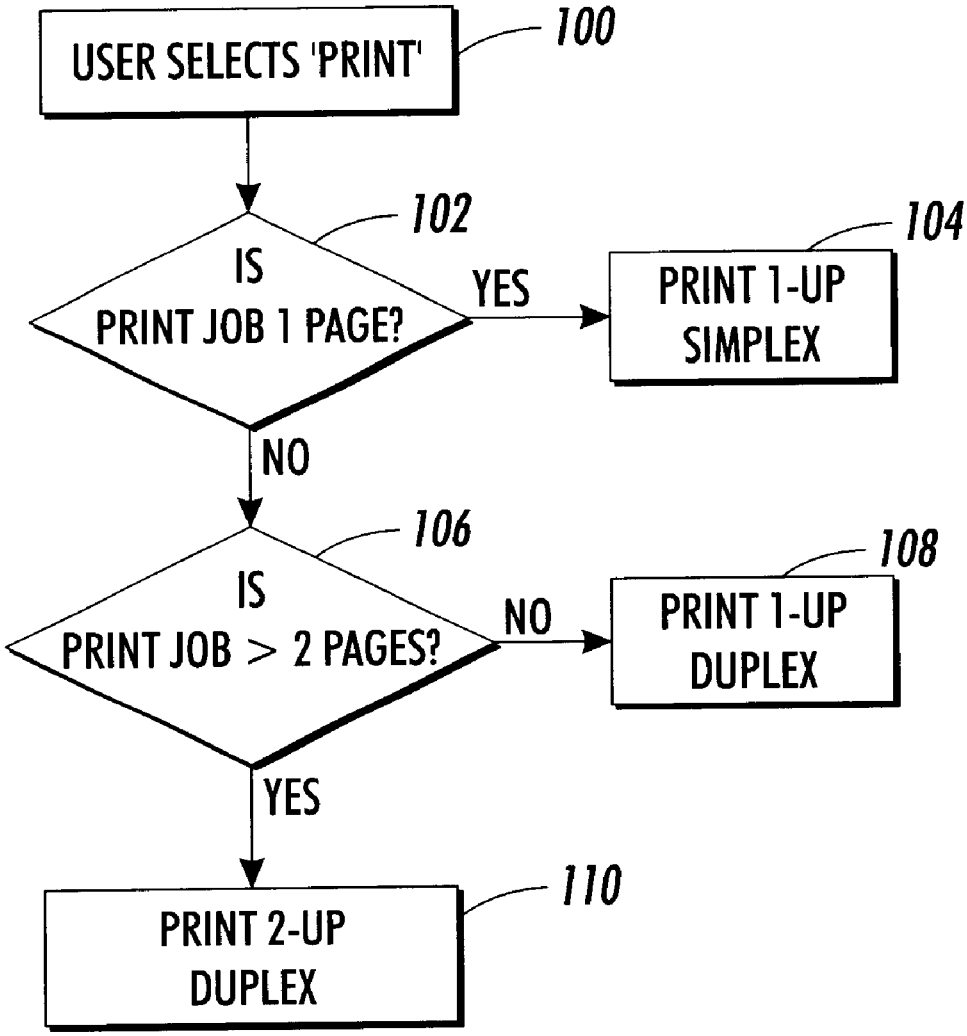
FIG. 4 is a flow chart illustrating a method of operating a printing device.

FIG. 4 summarizes the basic process that occurs in embodiments when a user prints a document with the smart paper saving mode selected.

First, at 100 the user selects a feature from either an application interface or a printing device user interface that sends a document to the printing device. This feature may be labeled a variety of ways including, but not limited to, 'print' and 'OK' (such as the feature 34 shown in FIG. 3). In the case where a user prints from his desktop, the application then transmits the user-selected details of the print job to the print driver. The print driver receives the parameters from the application. The driver then determines how many pages are in the document. In the case where the user prints directly at a printing device, the controller would directly receive the print information and determine how many pages are in the document.

From here onward, the term "print controller" will be used to refer to both print drivers and internal controllers.

At 102, the print controller determines whether the document is one page. If it is one page, then at 104, the print controller prints the document in 1-up and simplex (single-sided) format.

If the print controller determines that the print job is more than one page at 102, then the print controller proceeds to determine whether the document is more than two pages at 106. If the print controller determines that the document is not longer than two pages at 106, then at 108 the print controller prints the document in 1-up and duplex (double-sided) format. The document is printed on both the front side and the back side of a substrate.

Figure 5A:
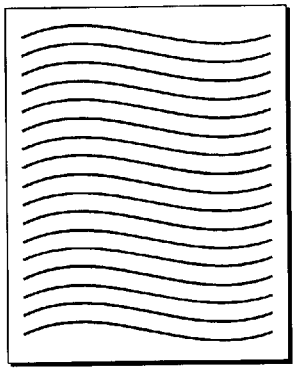
FIG. 5A represents a first sheet having text or an image thereon.
Figure 5B:
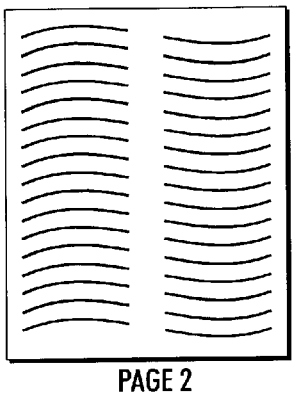
FIG. 5B represents a second sheet having text or an image thereon.
Figure 5C:
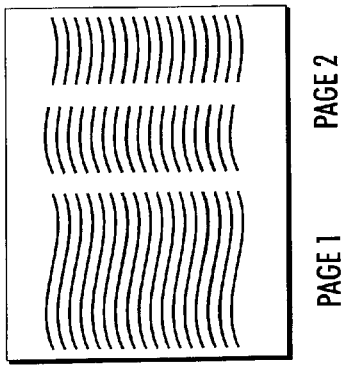
FIG. 5C represents a third sheet having the images from the first and second sheets in a 2-up format thereon.

If the print controller determines that the document is more than two pages at 106, then at 110 the print controller automatically prints the document in 2-up format as well as duplex format. Printing 2-up means printing two pages on one side of a sheet of paper. The two pages are printed side-by-side in landscape format. FIGS. 5A, 5B, and 5C show this process. 2-up printing saves paper on large jobs, but it is not efficient or desirable to print a one or two page document half-size when it would only require one sheet of paper to be printed at full size. However, when more than two sheets of paper are required for a print out, printing 2-up can save paper.

To more fully illustrate the process, consider the case when a user desires to print a four-page document, such as four pages of paper. A four-page document being printed on 8.5×11 inch paper with the Smart Paper Saving Mode box 40 unchecked would print out on the fronts of four sheets of paper. With the box 40 checked, pages 1 and 2 would print out side by side on the front of one 8.5"×11" sheet in landscape format. To enable pages 1 and 2 to fit on one sheet, their dimensions would be reduced to 5.5"×8.5". Pages 3 and 4 would also be printed the same way. Further, because automatic duplexing is in place for documents 2 pages or longer, pages 3 and 4 will end up printing on the reverse side of the same sheet as pages 1 and 2. As this example shows, the layout of the present embodiment uses as little as one-fourth the paper of a single sided 1-up layout.

The preceding paragraphs describe one basic embodiment of the invention. Alternative embodiments include other options and exceptions to the general method. For example, the above-described method may not work so well when certain substrates are used. For example, if the user prints out multiple pages on transparencies, printing duplex would cause the output to be illegible. Also, if the user attempts to print a formal letter, the user would generally not want the first page 2-up as the letterhead may obscure some of the text of the letter.

Figure 6:
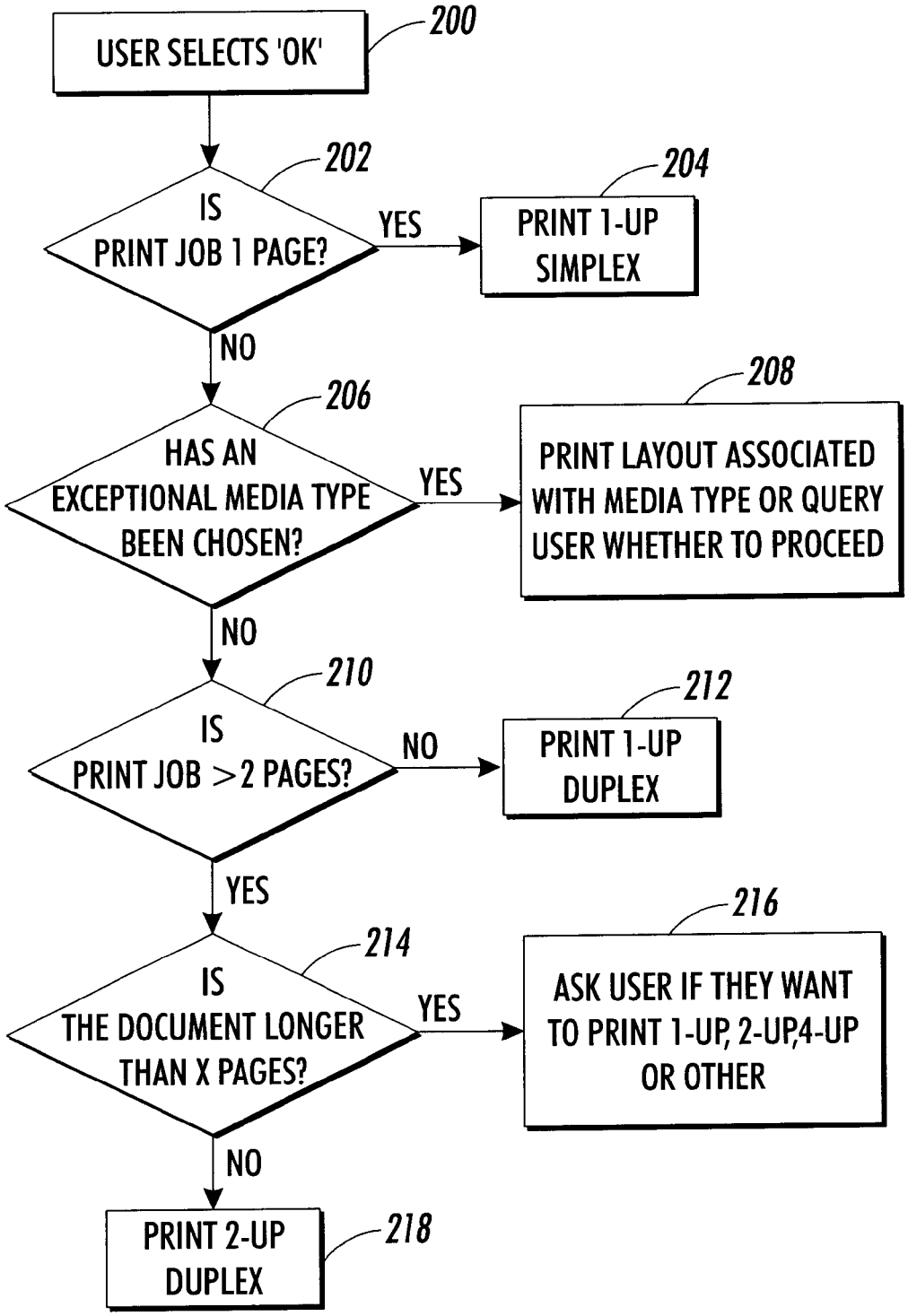
FIG. 6 is a flow chart illustrating another method of operating a printing device.

FIG. 6 summarizes an embodiment of a more detailed process that the print controller can follow when the smart paper saving mode is selected. Any or all of these added process elements can be programmed into the print controller.

First, at 200 the user selects a feature from either an application interface or a printing device user interface that sends a document to the printing device. This feature may be labeled a variety of ways including, but not limited to, 'print' and "OK" (as shown in FIG. 3). The application then transmits the user-selected details of the print job to the print controller. The print controller receives the parameters from the application. The print controller then determines how many pages are in the document.

At 202, the print controller determines whether the document is more than one page. If it is not more than one page, then at 204, the print controller prints the document in a 1-up, simplex format.

If the print controller determines that the print job is more than one page at 202, then the print controller proceeds to determine whether an exceptional media type has been chosen at 206. Exceptional media type refers to any substrate where a user would never or almost never want to use the layout used by the paper-conserving mode. Exceptional media types can include, but are not limited to, transparencies and letterhead.

There are multiple ways that the print controller can determine the substrate on which a document is to be printed. The user may indicate the substrate being printed on at the time of printing by, for example, selecting a particular substrate through the user interface prior to selecting "OK" or "Print" in the interface. For example, Document Centre devices feature very convenient auto tray selection. You specify the color, size, and type of media that you want, and the printing device finds what tray it is in and uses it. If the paper is not loaded in any tray, then the printing device prompts the user to insert it. Alternatively, the user may simply select a particular tray knowing that it contains a particular substrate. The print controller can be programmed to associate certain trays with certain substrates. For example, the print controller may associate transparencies with paper feed tray 4. If tray 4 is selected it will assume a transparency is what intended for the output. The printing device also may automatically select a substrate upon scanning in a document.

If the print controller determines that the substrate on which the document to be printed is an exceptional media type at 206, then at 208 action is taken by the print controller.

Step 208 lists two alternative actions the print controller could take. However, these actions are not an exhaustive list. In some embodiments, the print controller could automatically print the document in a manner that would be appropriate for that substrate. For example, if the substrate is one on which the user is not likely to want to print in duplex format, such as a transparency, the print controller might print the document in simplex format. For letterhead, the print controller might print the first page 1-up and subsequent pages 2-up.

Figure 7:
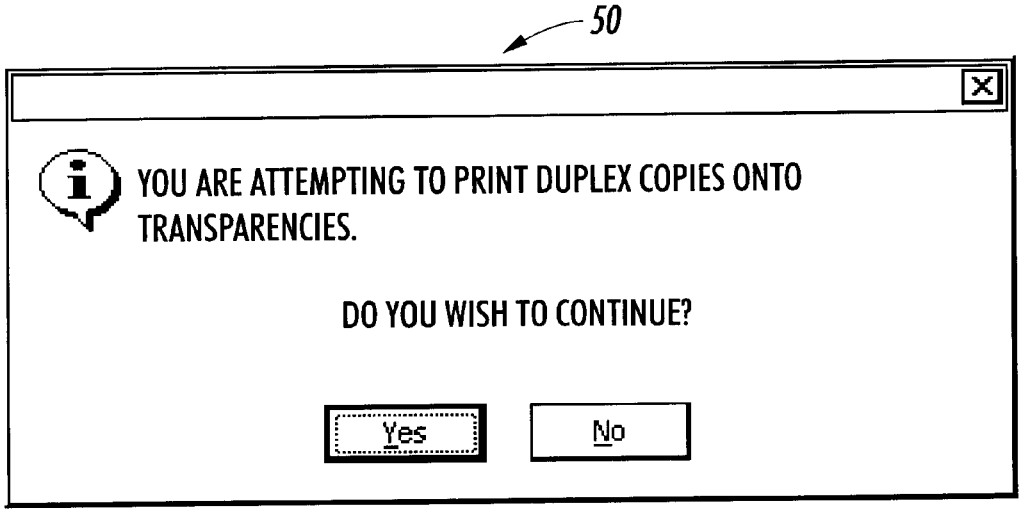
FIG. 7 is an example of a feature generated by a print driver.

In embodiments, when an exceptional media type is selected, the print controller could simply cause a feature, such as that shown in FIG. 7, to appear on the screen. FIG. 7 illustrates a box 50 that would be displayed if someone tried to print a multi-page transparency with the Smart Paper Saving Mode box selected. The user has the option of selecting yes to continue printing or no to interrupt printing and change the settings. The text in box 50 in FIG. 7 is meant to be exemplary and should be considered limiting. In cases where the user wanted to print a three or more page letter on letterhead, the text in box 50 could read, "You are attempting to print 2-up copies onto letterhead. Do You Wish to Continue?"

When the print controller determines that the substrate on which the document to be printed is not an exceptional media type at 206, then the print controller proceeds to determine whether the print job is more than two pages at 210. If the print controller determines that the print job is not more than two pages then the print controller prints the document 1-up, duplex form at 212.

When the print controller determines that the document is more than two pages at 210, then at 214 the print controller proceeds to determine whether the print job is longer than X pages, where X is some integer. This is another optional feature. There are a few reasons to include step 214. For example, a user may not want to print a particular document 2-up. This might be the case, for example, where a document was particularly large. It would be a considerable waste of paper to print out the document in 2-up format, only to throw it out or recycle it. Alternatively, for example, a user may want to print a document over a certain size 4-up or M-up where M is an integer greater than 2. This would further conserve paper, although at the cost of reducing image size further. The value of X will depend upon the user's purposes for having step 214. For example, the user may want to print every document that is 5 pages or more 4-up, or the user may want a check in place when printing documents greater than 100 or even 20 pages. The value of X could be set for the user before purchasing or after purchasing. If the print controller determines that the print job is longer than X pages, then at 216 the print controller could simply cause a feature, such as that shown in FIG. 7 to appear. In this case, it could ask the user if they wanted to print 1-up, 2-up, 4-up, or other.

When the print controller determines that the document is not more than two pages at 214, then at 218 the print controller automatically prints the document in 2-up format as well as duplex format.

Figure 8:
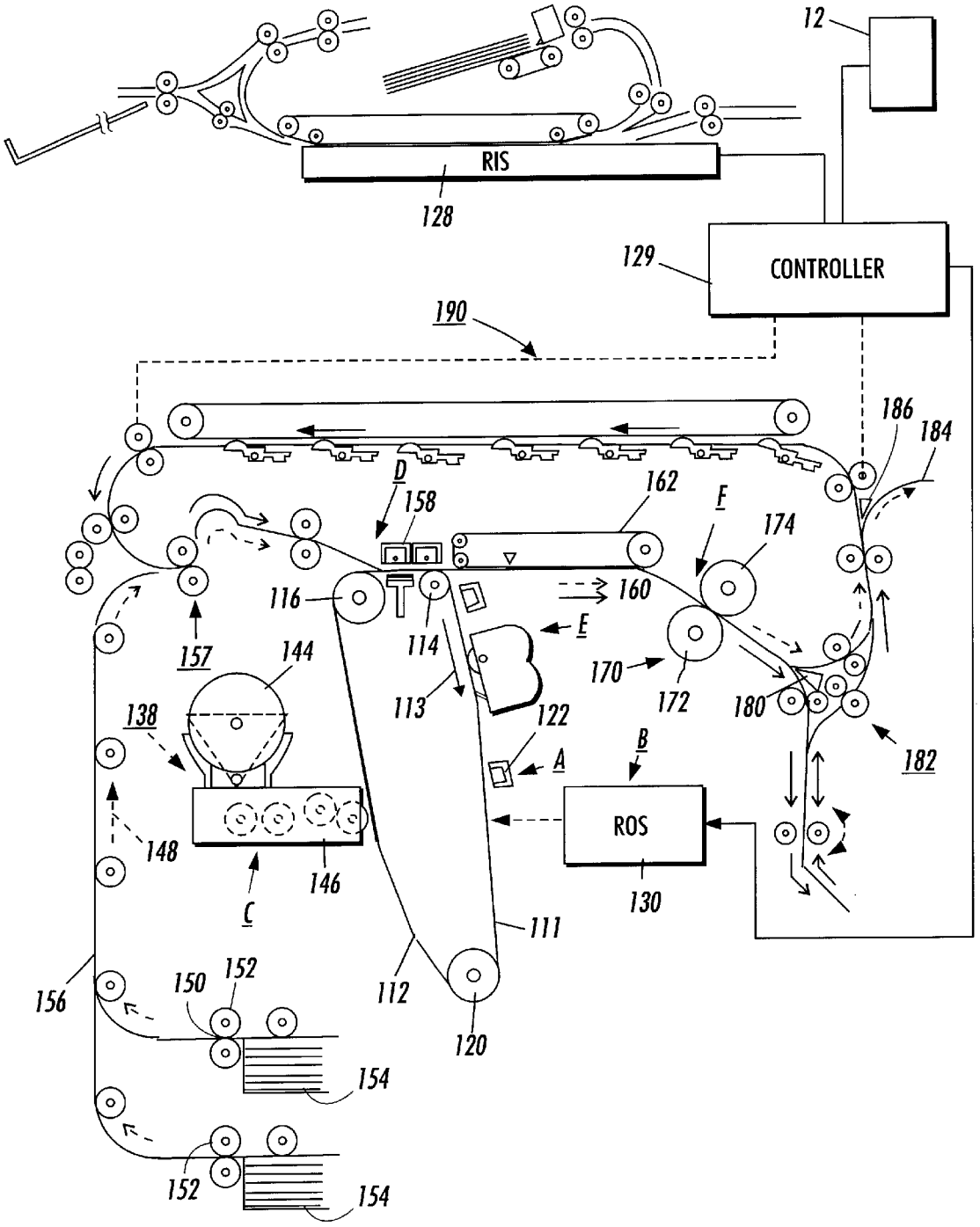
FIG. 8 is a schematic elevational view of an electrophotographic printing machine in which the present invention can be useful.

The methods disclosed herein can be used with a variety of printing devices. For example, either of the printing devices (18, 20) shown in FIG. 1 may be a printing device such as that described in U.S. Pat. No. 5,467,182, hereby incorporated by reference in its entirety. FIG. 8 schematically depicts the various components of an embodiment of a printing device. It should be obvious to those skilled in the art that the embodiments disclosed herein could be used with a variety of printing machines. The printing device of FIG. 8 is meant to be exemplary and the description of its components is not meant to be limiting in any manner.

FIG. 8 schematically illustrates a printing device 18 that could be connected to the computer 12 of FIG. 1. The printing device 18 can be an electrostatographic or xerographic machine. The printing device has a controller 129. Preferably, the controller or electronic subsystem (ESS) 129 is a self-contained, dedicated minicomputer. The image signals transmitted to ESS 129 may originate from a raster input scanner 128 or from a computer 131, thereby enabling the electrophotographic printing machine to serve as a remotely located printer for one or more computers as shown in FIG. 1.

The machine 18 generally employs a photoconductive belt 111. Preferably, the photoconductive belt 111 is made from a photoconductive material coated on a ground layer, which, in turn, is coated on an anti-curl backing layer. Belt 111 moves in the direction of arrow 113 to advance successive portions sequentially through the various processing stations disposed about the path of movement thereof. Belt 111 is entrained about stripping roller 114, tensioning roller 116 and drive roller 120. As roller 120 rotates, it advances belt 111 in the direction of arrow 113.

Initially, a portion of the photoconductive surface passes through charging station A. At charging station A, a corona generating device indicated generally by the reference numeral 122 charges the photoconductive belt 111 to a relatively high, substantially uniform potential.

At an exposure station, B, the controller 129 receives the image signals representing the desired output image and processes these signals to convert them to a continuous tone or grayscale rendition of the image which is transmitted to a modulated output generator, for example the raster output scanner (ROS), indicated generally by reference numeral 130.

The signals from ESS 129, corresponding to the continuous tone image desired to be reproduced by the printing machine, are transmitted to ROS 130. ROS 130 includes a laser with rotating polygon mirror blocks. Preferably, a nine facet polygon is used. The ROS illuminates the charged portion of photoconductive belt 111 at a resolution of about 300 or more pixels per inch. The ROS will expose the photoconductive belt to record an electrostatic latent image thereon corresponding to the continuous tone image received from ESS 129. As an alternative, ROS 130 may employ a linear array of light emitting diodes (LEDs) arranged to illuminate the charged portion of photoconductive belt 111 on a raster-by-raster basis.

After the electrostatic latent image has been recorded on photoconductive surface 112, belt 111 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 144, dispenses toner particles into developer housing 146 of developer unit 138.

With continued reference to FIG. 8, after the electrostatic latent image is developed, the toner powder image present on belt 111 advances to transfer station D. A print sheet 148 is advanced to the transfer station, D, by a sheet feeding apparatus, 150. Preferably, sheet-feeding apparatus 150 includes a feed roll 152 contacting the uppermost sheet of stack 154. Feed roll 152 rotates to advance the uppermost sheet from stack 154 into vertical transport 156. Vertical transport 156 directs the advancing sheet 148 of support material into registration transport 157 past image transfer station D to receive an image from photoreceptor belt 111 in a timed sequence so that the toner powder image formed thereon contacts the advancing sheet 148 at transfer station D. Transfer station D includes a corona-generating device 158 that sprays ions onto the back side of sheet 148. This attracts the toner powder image from photoconductive surface 112 to sheet 148. After transfer, sheet 148 continues to move in the direction of arrow 160 by way of belt transport 162, which advances sheet 148 to fusing station F.

Fusing station F includes a fuser assembly indicated generally by the reference numeral 170 which permanently affixes the transferred toner powder image to the copy sheet. Preferably, fuser assembly 170 includes a heated fuser roller 172 and a pressure roller 174 with the powder image on the copy sheet contacting fuser roller 172. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 172.

The sheet then passes through fuser 170 where the image is permanently fixed or fused to the sheet. After passing through fuser 170, a gate 180 either allows the sheet to move directly via output 184 to a finisher or stacker, or deflects the sheet into the duplex path 190, specifically, first into single sheet inverter 182 here. That is, if the sheet is either a simplex sheet or a completed duplex sheet having both side one and side two images formed thereon, the sheet will be conveyed via gate 80 directly to output 184. However, if the sheet is being duplexed and is then only printed with a side one image, the gate 180 will be positioned to deflect that sheet into the inverter 182 where that sheet will be inverted. An additional gate 186 selects between output 116 and dedicated duplex return loop 190 for recirculation back through transfer station D and fuser 170 for receiving and permanently fixing the side two image to the backside of that duplex sheet, before it exits via exit path 184.

After the print sheet is separated from photoconductive surface 112 of belt 111, the residual toner/developer and paper fiber particles adhering to photoconductive surface 112 are removed therefrom at cleaning station E. Cleaning station E includes a rotatably mounted fibrous brush in contact with photoconductive surface 112 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 112 with light to dissipate any residual electrostatic charge remaining thereon prior to the charging thereof for the next successive imaging cycle.

The controller 129 regulates the various machine functions. The controller 129 is preferably a programmable microprocessor that controls all of the machine functions hereinbefore described. The controller 129 can also comprise the embodiments of the printing method discussed herein. Alternatively, the controller may be in communication with the print driver of, for example, computer 12 in FIG. 1, in which case, the print driver instructs the controller 129 on how to print a document. The controller 129 then proceeds to print the document according to instructions it receives from the print driver, including 2-up or duplex as instructed.

The embodiments disclosed herein could also be used with other types of printing devices. For example, facsimile machine 22 in FIG. 1 can be set to receive incoming documents in a paper-saving mode. This mode can include being programmed to print 2-up, and possibly even duplex for fax machines with this capability.

While the present invention has been described in connection with specific embodiments thereof, it will be understood that it is not intended to limit the invention to these embodiments. It is intended to encompass alternatives, modifications, and equivalents, including substantial equivalents, similar equivalents, and the like as may be included within the spirit and scope of the invention as defined by the appended claims.

What is claimed:

1. A printing method, comprising:

receiving a document to be printed;

determining the number of pages in the document;

printing the document in simplex, 1-up form when the document is not longer than one page;

printing the document in duplex, 1-up form when the document is not longer than 2 pages;

printing the document in duplex, 2-up form when the document is longer than 2 pages.

2. The method of claim 1 further comprising printing a document N-up when the document is at least X pages, where X is greater than 4.

3. The method of claim 2 wherein the value of N is 4.

4. The method of claim 1, further comprising displaying a feature to the user requesting confirmation from the user before printing when the document is at least X pages, where X is greater than 4.

5. The method of claim 4, wherein X is at least 20.

6. The method of claim 1 further comprising displaying a feature to the user requesting confirmation from the user before printing when the media type on which the document is to be printed is one of a plurality of predetermined exceptional media types.

7. The method of claim 6, wherein the plurality of exceptional media types includes transparencies and letterhead.

8. The method of claim 1, wherein the layout is simplex and 1-up when the media to be printed on is a transparency, regardless of the number of pages in the document.

9. A printing method, comprising:

determining the number of pages in a document to be printed, automatically selecting a paper-conserving print layout for the document when at least two pages are detected;

displaying a feature to the user requesting confirmation from the user before printing when the document is longer than X pages;

printing the document according to the paper-conserving print layout.

10. The method of claim 9, wherein automatically selecting a paper-conserving layout includes selecting duplex when the document has at least 2 pages.

11. The method of claim 10, wherein automatically selecting a paper-conserving layout includes selecting 2-up when the document is longer than 2 pages.

12. The method of claim 9, wherein automatically selecting a paper-conserving layout includes selecting N-up when the document is at least X pages, where X is greater than 4.

13. The method of claim 12, wherein the value of N is 4.

14. The method of claim 9, wherein X is at least 20.

15. The method of claim 9 further comprising displaying a feature to the user requesting confirmation from the user before printing when the media type on which the document is to be printed is one of a plurality of predetermined exceptional media types.

16. The method of claim 15, wherein the plurality of exceptional media types includes transparencies and letterhead.

17. The method of claim 9, wherein the layout is simplex and 1-up when the media to be printed on is a transparency, regardless of the number of pages in the document.

18. The method of claim 9, wherein the method is implemented in a print driver.

19. A controller for a printing apparatus, wherein the controller determines the number of pages in a document to be printed;

selects duplex printing when the document has at least 2 pages, selects 2-up printing when the document more than 2 pages, and selects N-up printing when the document is longer than X pages, where X is greater than 4; and prints the document.

* * * * *